US006920226B2

(12) United States Patent
Sauer

(10) Patent No.: US 6,920,226 B2
(45) Date of Patent: Jul. 19, 2005

(54) HEARING AID HAVING A DEACTIVATABLE SIGNAL PROCESSING DEVICE, AND DEACTIVATION METHOD

(75) Inventor: Gunter Sauer, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 314 days.

(21) Appl. No.: 10/388,817

(22) Filed: Mar. 14, 2003

(65) Prior Publication Data

US 2004/0008854 A1 Jan. 15, 2004

(30) Foreign Application Priority Data

Mar. 14, 2002 (DE) ..... 102 11 364

(51) Int. Cl.[7] ..... H04R 25/00

(52) U.S. Cl. ..... 381/312; 381/23.1; 381/315; 381/123; 381/323

(58) Field of Search ..... 381/312, 313, 381/314, 315, 323, 331, 123, 120, 96, 23.1

(56) References Cited

U.S. PATENT DOCUMENTS 6,768,802 B1 * 7/2004 Baechler ..... 381/315

FOREIGN PATENT DOCUMENTS

DE OS 2 313 108 10/1973
GB 1 425 527 3/1973

OTHER PUBLICATIONS

Patent Abstracts of Japan Publication No. 60123198 A, for Japanese Application No. 58230581.

* cited by examiner

*Primary Examiner*—Huyen Le
*Assistant Examiner*—Tuan Duc Nguyen
(74) *Attorney, Agent, or Firm*—Schiff Hardin LLP

(57) ABSTRACT

For reducing the power consumption of a hearing aid system, an internal or external hearing aid signal source with a signal line for the transmission of a signal to a hearing aid amplifier and a control device for the connection and disconnection of the hearing aid signal source is provided in the hearing aid. A monitoring logic monitors the signal line and supplies a switch signal to the control device, so that the hearing aid signal source can be connected and disconnected on the basis of the switch signal. Each signal source can thus be individually connected and disconnected without employing additional connections from the hearing aid system to the signal source.

8 Claims, 2 Drawing Sheets

HEARING AID HAVING A DEACTIVATABLE SIGNAL PROCESSING DEVICE, AND DEACTIVATION METHOD

BACKGROUND OF THE INVENTION

1. Field of the Invention

The present invention is directed to a signal-processing device for hearing aids of the type having a signal line for the transmission of a signal to a hearing aid amplifier and having a control device for the connection and disconnection of the hearing aid signal source. The present invention also is directed to a hearing aid having one or more of these signal-processing devices as well as to a method for the operation of the signal processing devices. What is thereby understood by a signal-processing device means any device that can serve as signal source for the hearing aid amplifier.

2. Description of the Prior Art

A number of internal and external signal sources can be connected to a hearing aid system. Microphones and telephone coils with or without an integrated pre-amplifier and/or an integrated analog-to-digital converter are examples of such signal sources. Due to the limited energy supply possibilities, the problem of being able to connect and disconnect individual signal sources—possibly with their signal processing devices—separately from one another. In the case of a disconnect, the signal sources should be placed into a condition that results in a low power consumption (standby mode).

A fundamental idea for solving the problem is to reduce the power consumption, i.e., the signal sources are shut off by the hearing aid amplifier when they are not required. Techniques are known for this purpose.

When the signal sources or signal processing devices are fed via a common supply line, then they can be deactivated in common by shutting off the supply voltage. Likewise, all signal sources can be activated by the common supply line being supplied with voltage.

When the individual signal sources are provided with separate supply lines, then each individual source can be separately connected to or disconnected from the hearing aid amplifier. In this case, however, individual supply lines must be provided from the hearing aid amplifier to each signal source. Additional lines as well as additional terminals at the hearing aid system are thus required.

When the individual signal sources are in fact centrally supplied with voltage but are connected to the hearing aid system by additional signal lines, then it is likewise possible to connect or disconnect individual signal sources. The disadvantage that additional lines and terminals must be provided, however, also exists in this case.

In this context, German Published Application 2 313 108 discloses a circuit for the power supply of amplifiers, wherein an input signal is amplified in a pre-amplifier that is fed from a supply source. The output signal of the pre-amplifier is supplied to the amplifier and control means. When the control means find that the first signal has arrived at the input, then the amplifier is driven with a high feed current. When the control means find that the second signal has arrived at the input, then the feed current for the amplifier is set to the economy power value. The amplifier amplifies the output signal of the pre-amplifier, whereas the output signal of the amplifier is reproduced in a playback device, for example a speaker.

Further, Japanese Patent Application 60 123 198 discloses a hearing aid that has a specific circuit for reducing the power consumption. A detector circuit compares the output level of a high-frequency amplifier to a reference voltage and emits an output signal with a high level when the output level is higher than the reference voltage. A voltage supply disconnect circuit activates a switch element only when the detector circuit generates the signal with high level and thus applies the battery voltage to the electrical circuitry of the hearing aid. The battery voltage is disconnected given too low an output level of the amplifier, in order to reduce the power consumption. This Japanese application, however, is directed only to a hearing having one signal source or one signal-processing path.

SUMMARY OF THE INVENTION

An object of the present invention is to individually assure the connection and disconnection of signal processing devices without having to provide additional lines and terminals therefor.

The above object is achieved in accordance with the principles of the present invention in a hearing aid having a deactivatable signal processing device, as well as in a method for controlling deactivation of the signal processing device, wherein a preamplifier feeds a signal line which is monitored as to its signal level and, dependent on the monitoring, the signal line is switched from being connected to the preamplifier to connection to a driver that has a lower power consumption than the preamplifier, and the preamplifier is disconnected from the signal line when the driver is connected to the signal line.

Advantageously and despite individual disconnection, thus, a number of signal sources can be connected to a common power supply, and additional signal lines need not be installed in addition to the signal lines that are already present.

DESCRIPTION OF THE PREFERRED EMBODIMENTS

Figure 1:
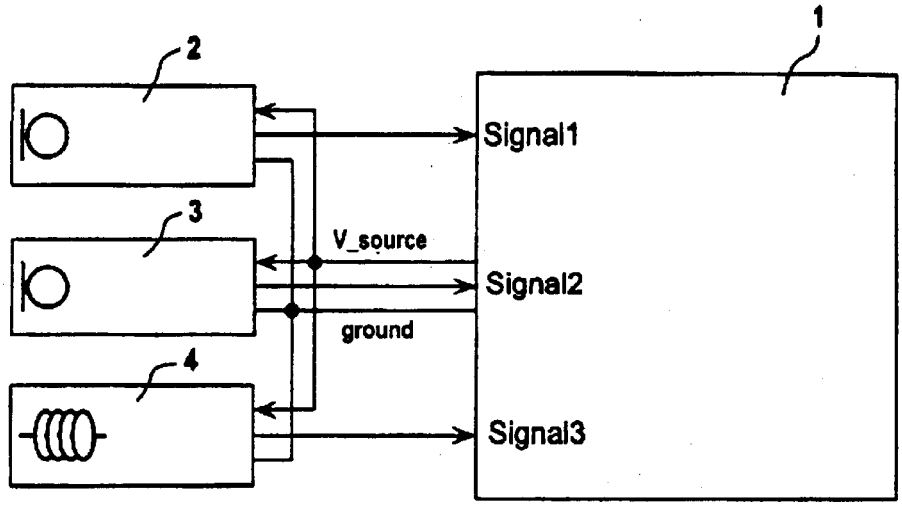
FIG. 1 is a schematic circuit diagram of a hearing aid amplifier having a number of signal sources.

FIG. 1 is a schematic circuit diagram of a hearing aid amplifier 1 to which two microphones 2 and 3, which each have an integrated pre-amplifier and AD converter, and a telephone coil 4, likewise having an integrated amplifier and AD converter, are connected. As signal sources, the two microphones 2, 3 and the telephone coil 4 supply the signals Signal 1, Signal 2 and Signal 3 to the hearing aid amplifier 1 via their respective signal lines. The hearing aid amplifier 1 in turn supplies the signal sources 2, 3, 4 with current via a common line that branches for the three sources. This is indicated by the two lines with the references “”Ground” and “V_source”. The important fact is that only one voltage supply line, with a ground pole and an operating voltage pole leads from the hearing aid amplifier 1 to the signal sources, so that a shared, central voltage supply, is achieved. Moreover, there is a separate signal line for each of the signal sources 2, 3, 4.

Figure 2:
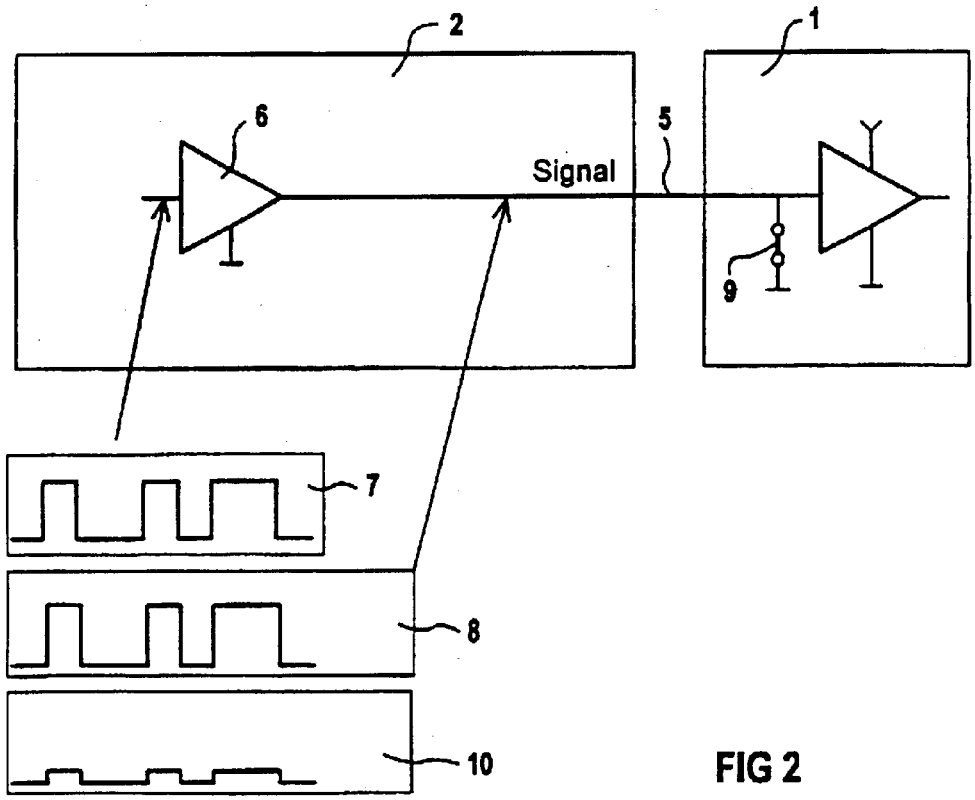
FIG. 2 shows the signal curve at a signal source with integrated pre-amplifier and AD converter.

FIG. 2 shows a signal source 2 that is connected to the hearing aid amplifier 1 via a signal line 5. The signal source 2 has a pre-amplifier 6 at whose input a digital data signal 7 is present. This data signal is obtained from a detector (not shown), for example a microphone, and from a following AD converter (likewise not shown). The signal 8 is present at the signal line 5 at the output of the pre-amplifier.

The input of the hearing aid amplifier 1 or, respectively, the signal line 5 can be connected to ground in low-impedance fashion with a first switch 9. This means that, when the first switch 9 is closed, the signal line can no longer be pulled to a high level "high" by the pre-amplifier 6. By contrast, the signal curve that occurs when the first switch 9 is closed corresponds to the signal curve 10 shown in FIG. 2. This means that the two signal levels "low" and "high" hardly differ and lie in the proximity of ground. This also analogously applies when the signal line is connected low-impedance to the operating voltage line with the first switch 9.

Figure 3:
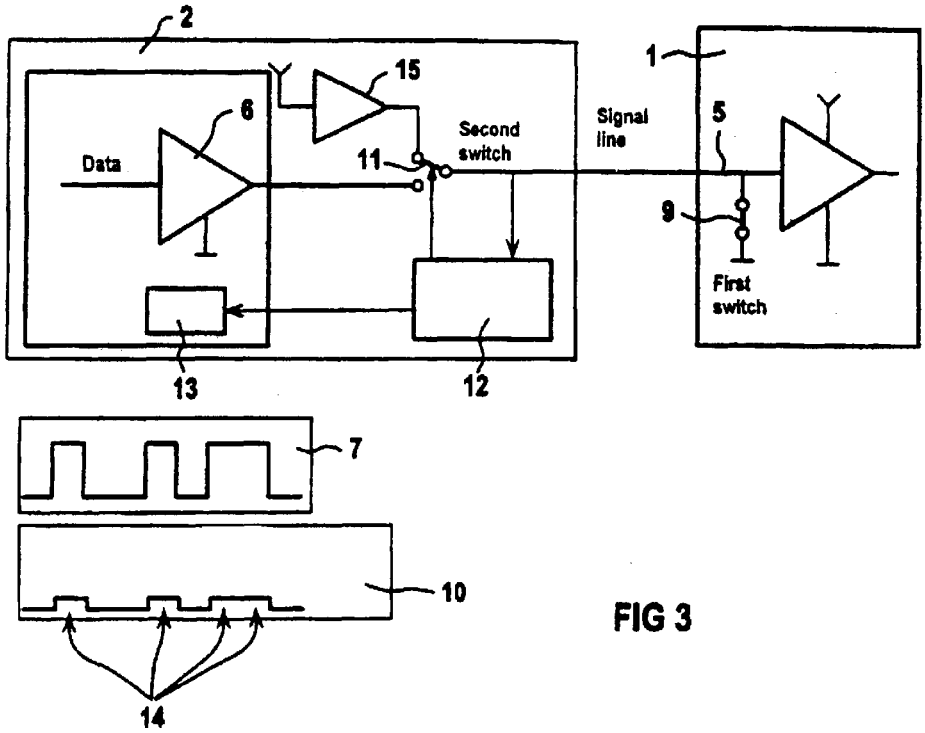
FIG. 3 is a circuit diagram of an inventive signal source.

FIG. 3 shows a more detailed signal circuit diagram of the signal source 2. The pre-amplifier 6 feeds the signal line 5 via a second switch 11. The signal line 5 is tapped by a monitoring circuit 12. This monitoring circuit 12 controls the second switch 11 and supplies a sample (signal or switch or control signal) to a shutoff control device 13. This deactivates the pre-amplifier 6 of the signal source 2 and, if present, further power users on the basis of the switch signal from the monitoring circuit 12. To this end, the monitoring circuit 12 monitors the signal line at specific, discrete times 14. When the signal is below a prescribed threshold at these sampling times 14, then the monitoring circuit 12 recognizes that the first switch 9 of the amplifier 1 is closed, so that the signal source 2 or the pre-amplifier 6 can be shut off. In a specific version, the signal line is always checked by the monitoring logic or circuit 12 whenever the data are at the "high" level. If the signal line does not likewise lie at the "high" level, then the signal source 2 is deactivated.

For connecting the signal source 2, it is not sufficient to open the first switch 9 because the deactivated pre-amplifier 6 cannot pull the signal line 5 to a "high" level needed for connecting. It is therefore necessary for a driver 15 with low power consumption to remain active in the signal source 2 even during the deactivated condition of the pre-amplifier 6. In the deactivated condition of the pre-amplifier 6, the output of the weak driver 15 is connected to the signal line 5 via the second switch 11. The low power driver 15 can thus drive the signal line 5 back to the "high" level when the first switch 9 in the hearing aid amplifier 1 is opened again. The monitoring circuit 12 recognizes this, so that the signal source 2 is reconnected.

Figure 4:
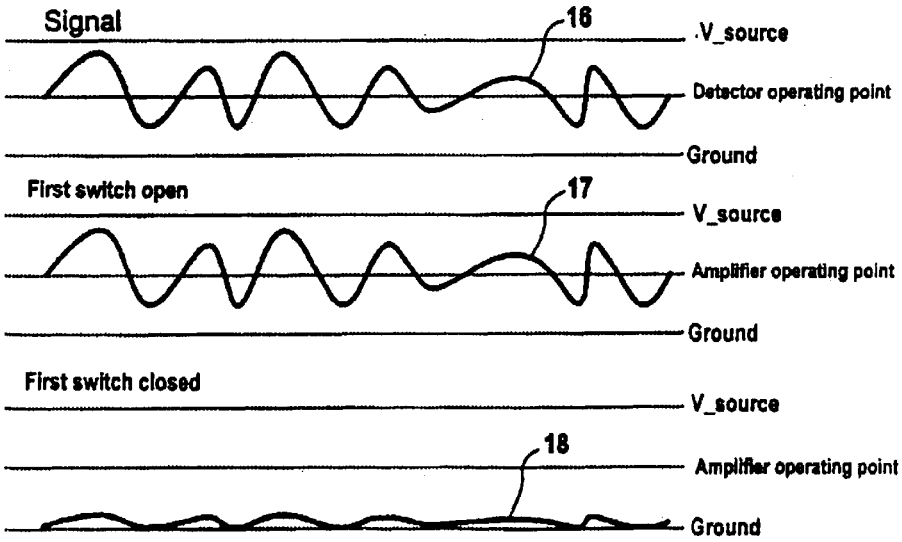
FIG. 4 shows the signal curve in the case of an inventive analog circuit.

FIG. 4 shows the signal curve in the signal line 5 given an analog signal source 2. The analog signal of a detector is supplied to the input of the pre-amplifier 6 and has the signal shape 16 shown in FIG. 4. This varies around a detector operating point between ground and a source voltage V_source. After the pre-amplification, the analog signal has essentially the same signal shape during normal operation when the first switch 9 is open, possibly with different signal values. This pre-amplifier signal 17 ranges around the operating point of the pre-amplifier 6. When, however, the first switch 9 is closed, then the output signal of the pre-amplifier 2 is pulled toward ground, corresponding to the signal shape 18. On the basis of the mean value, for example, the monitoring circuit 12 detects that the signal 18 no longer ranges around the operating point of the pre-amplifier 6, so that the signal source 2 can be shut off.

In the aforementioned exemplary embodiments, the input of the hearing aid amplifier 1 is selected to be high-impedance in the normal case. When the amplifier input is switched to low-impedance, the respective signal source or component recognizes this and shuts down. In general, however, the hearing aid system can deactivate the signal source by modifying an arbitrary electrical property of the signal input. To this end, the signal source must detect the corresponding electrical property of the signal input. Given specific, pre-defined values, the signal source can then disconnect itself and switch into a state of lower power consumption. As an alternative to the purely ohmic evaluation, for example, an evaluation of the complex resistance of the signal input of the hearing aid system could ensue.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

a preamplifier which amplifies an incoming signal, and which supplies an amplified output signal to a signal line; a control device connected to said preamplifier for activating and deactivating said preamplifier;

a driver that operates with a lower power consumption than said preamplifier, said driver having a driver output;

a switch connected between said signal line and said output of said preamplifier and said driver output for, dependent on a switching state of said switch, connecting one of said driver output and said output of said preamplifier to said signal line; and a monitoring circuit connected to said switch, said control device and to said signal line for monitoring a signal level on said signal line and, dependent on said signal level, for operating said switch to connect said one of said output of said preamplifier and said driver output to said signal line and for operating said control circuit to deactivate said preamplifier when said driver output is connected to said signal line.

2. A hearing aid as claimed in claim 1 comprising a plurality of hearing aid components connected to said control device which are activated and deactivated by said control device together with said preamplifier, dependent on said signal level monitored by said monitoring circuit.

3. A hearing aid as claimed in claim 1 wherein said preamplifier supplies a binary voltage signal to said signal line having a high-voltage level and a low-voltage level, and wherein said monitoring circuit always monitors said signal level at signal line during said high-voltage level.

4. A hearing aid as claimed in claim 1 wherein said preamplifier supplies an analog signal to said signal line, said analog signal having a constant component which is monitored by said monitoring circuit.

5. A hearing aid as claimed in claim 1 wherein said preamplifier, said control device, said driver and said switch comprise a first signal processing circuit, and wherein said hearing aid comprises a plurality of further signal processing circuits, identical to said first signal processing circuit, and an amplifier having an input connected to the respective signal lines of said first signal processing circuit and said plurality of further signal processing circuits, and a switch preceding said input of said amplifier operable to connect a respective signal lines selectively to ground or to a supply voltage.

6. A method for controlling a signal-processing device of a hearing aid, comprising the steps of:

connecting a preamplifier of a signal-processing device to a signal line via a switch;

connecting a driver to said signal line via said switch, said driver having a lower power consumption than said preamplifier;

monitoring a signal level at said signal line and operating said switch dependent on said signal level to connect one of said preamplifier and said driver to said signal line dependent on said signal level.

7. A method as claimed in claim 6 comprising connecting said signal line to a hearing aid amplifier and switching said signal line to ground or to a supply voltage preceding said hearing aid amplifier when said driver is connected to said signal line.

8. A method as claimed in claim 6 comprising deactivating a plurality of further components in said hearing aid when said driver circuit is connected to said signal line.

* * * * *